United States Patent [19]

Vadis

[11] Patent Number: 4,474,603

[45] Date of Patent: Oct. 2, 1984

[54] METHOD OF PRODUCING AN ORE PELLET

[76] Inventor: Marty K. Vadis, 3830 Fourth Ave., East, Hibbing, Minn. 55746

[21] Appl. No.: 422,834

[22] Filed: Sep. 24, 1982

[51] Int. Cl.[3] ..... C21B 1/08

[52] U.S. Cl. ..... 75/3; 75/5; 264/63

[58] Field of Search ..... 264/63; 75/3, 5

[56] References Cited

U.S. PATENT DOCUMENTS

| | | | |
|---|---|---|---|
| 2,417,493 | 3/1947 | Holz | 75/3 |
| 3,212,877 | 10/1965 | Rueckl | 75/3 |
| 3,326,668 | 6/1967 | Anthes et al. | 75/3 |
| 3,525,784 | 8/1970 | Endell | 264/63 |
| 3,765,869 | 10/1973 | Schierloh et al. | 75/3 |
| 3,811,865 | 5/1974 | Ladell | 75/3 |
| 3,819,360 | 6/1974 | Adams et al. | 75/3 |
| 3,886,244 | 5/1975 | Bayer et al. | 264/3 |

FOREIGN PATENT DOCUMENTS

| | | | |
|---|---|---|---|
| 517867 | 2/1940 | United Kingdom | 75/3 |

OTHER PUBLICATIONS

Auer, D. L. and R. L. Thayer, "Betonite Update: Production, Reserves, Quality Control, and Testing," *Society of Mining Engineering,* pp. 1467–1473 (Oct. 1979).

Scheel, J. H. and R. G. Lyons, "Direction of Pelletizing in the 80's," paper submitted at the 111th Annual Meeting of the SME-AIME at Dallas, Texas on Feb. 16, 1982.

*Primary Examiner*—James H. Derrington

*Attorney, Agent, or Firm*—Kinney & Lange

[57] ABSTRACT

A method of producing a taconite pellet including reducing the water content of naturally found Gyttja to a maximum of 50%, mixing the Gyttja with finely ground taconite ore, and pelletizing the finely ground taconite and Gyttja mixture to form a green pellet. The pellet is then processed to burn off the organic portion of the Gyttja and to harden the pellet.

6 Claims, No Drawings

METHOD OF PRODUCING AN ORE PELLET

BACKGROUND OF THE INVENTION

1. Field of the Invention

This invention relates to improvements in taconite pellets and to the processing of taconite iron ore into taconite pellets. In particular, the invention relates to an improved binding material for taconite pellets.

2. Description of the Prior Art

Taconite pellets and the production of taconite pellets have been well known for many years. Taconite pellets are currently the most widely used feed material for use in blast furnaces for the production of iron and steel. The major reasons for using taconite pellets for iron and steel production is to simplify handling, shipping and other operations to which the taconite ore is subjected, since the taconite ore is typically mined a great distance from the blast furnaces. Taconite pellets are considered superior to other processed iron ore material for feed into a blast furnace.

Taconite ore is a relatively low grade of iron ore found in the region of Lake Superior as a hard rock formation. Taconite ore contains approximately 50% silica and approximately 18–27% iron.

Many materials have been used as binders for making taconite pellets. Some of the binders include: Bentonite (Auer et al, "Bentonite Update: Production, Reserves, Quality Control, and Testing," *Society of Mining Engineering*, pp. 1467–1473 (October 1979)), peat moss (Anthes et al U.S. Pat. No. 3,326,668), organic binders such as carbon hydrate, carbohydrates, dextrin, starches (Schierloh et al U.S. Pat. No. 3,765,869), tree bark (Ladell U.S. Pat. No. 3,811,865), carbonaceous material such as pitch-coal tar (Rueckl U.S. Pat. No. 3,212,877) or petroleum and high volatile coal, a clay having a 10–20% by weight content of residual coal (Endell U.S. Pat. No. 3,525,784), Portland cement together with flue dust or sludge and a water solution as an adhesive binding agent such as molasses or silicate of soda (Holz U.S. Pat. No. 2,417,493), a form of clay which contains 10–20% by weight of residual coal, sawdust, straw, polymers and others (Anthes et al U.S. Pat. No. 3,326,668). Presently, Bentonite is the most popular material used as a binder in taconite pellets.

The trend in pelletizing taconite is further described in a paper entitled "Direction of Pelletizing in the 80's," which was submitted at the 111th Annual Meeting of SME-AIME by J. H. Scheel and R. G. Lyons at Dallas, Tex. on Feb. 16, 1982.

SUMMARY OF THE INVENTION

The present invention includes a method of producing an ore pellet using naturally found Gyttja as a binder. The method includes reducing the water content of the Gyttja to a maximum of 50% by weight. The Gyttja is then mixed with finely ground ore and pelletized to form a green pellet.

The green pellet is then preferably processed in a furnace or kiln by raising the temperature of the pellet sufficiently to burn off the organic portion of the Gyttja and harden the pellet.

DETAILED DESCRIPTION OF THE PREFERRED EMBODIMENT

To upgrade the iron content in iron ore, taconite must be processed to eliminate some of the non-iron portions of the ore. This is accomplished by finely grinding the ore to approximately −325 mesh and separating the iron portion from the non-iron portion of the ore. The finely ground iron ore is then mixed with a binder and formed into pellets in a pelletizing drum or disc. These pellets are typically called green pellets and generally contain approximately 8–12% water and are from $\frac{3}{8}''$ to $\frac{1}{2}''$ in diameter. The green pellets are then fired in a shaft-type furnace or placed on a traveling grate, preheated and fired in a rotary kiln between 1,000° to 1,200° C. The firing produces oxidation, which is an exothermic reaction and which, in turn, produces additional heat to the heat of the kiln or shaft furnace. The pellets are subsequently cooled and the result is a hard pellet which is resistant to deterioration during handling prior to the production of iron or steel. The pellet typically contains approximately 65–68% iron.

The present invention includes the use of Gyttja, an organic-rich lake sediment, as a binder for taconite ore to produce a taconite pellet. Gyttja is a naturally occurring material with truly unique physical properties, composition, and appearance. It is found in the profundal portion of basins of present lakes, and may also be confined in swamp-type sediments that were formed subsequent to the Gyttja's deposition in former lake basins.

The appearance of Gyttja may be described as finely divided grey, greyish-brown, brown-black, or dark colored with, at times, elastic consistency somewhat gelatinous, at times thixotropic, generally having a strong odor (of $H_2S$). Loosely compacted Gyttja has also been described as a "thickening organic soup" or an "organic rich ooze".

The composition of Gyttja may vary from one lake to another depending upon lake morphology; biota types and abundances, drainage, glacial history of the area, and geologic location. In composition Gyttja is partly organic and partly inorganic. In origin, Gyttja is either autochthonous (having been formed in the lake itself) or allochthomous (having been introduced into the lake from outside the lake).

The inorganic allochthonous particles in lake sediment have been introduced from effluents into the lake and are the fine fractions (generally clay or silt sized) of this effluent and account for most of the inorganic fraction of the sediments. The organic fraction of allochthonous sediments are made up of humic matter, derived from the leaching of the organic layer of soils and swamps, coarse organics from around the lake shoreline and animal matter such as hair, exudates, chitinous portions of insects, and a contribution of airborne dust, spores, and pollen may also be present.

Autochthonous sediments consist primarily of precipitates from physical-chemical processes (such as Fe and Mn hydroxides) and inorganic and organic remains of animal life from within the lake. Also, coagulated colloids of dissolved organic matter (such as organic acids) make up a part of the sediment.

In summary, Gyttja may be regarded as a mixture of organic gels, organic debris, and inorganic sediment (mostly silt and clay sized particles and clays).

The inorganic fraction of the sediments generally contain the following minerals: calcite, dolomite, aragonite, quartz, plagioclase, orthoclase, mica, ferromagnesian minerals, illite, kaolinite, and chlorite. The organic fraction can vary from a few percent to virtually all organics, but the typical lake will contain Gyttja having approximately a 20–75% by weight organic fraction.

Heretofore, Gyttja has been used as a tool to study trace metal dispersion in the environment and as a possible prospecting tool for locating ore bodies. Gyttja's makeup and prior use is well known as indicated in the following articles:

"The Formation and Detection of Metal Dispersion Halos in Organic Lake Sediments," by Timperley et al, *Journal of Geochemical Exploration,* Vol. 3, pp. 167–190 (1974);

"Lake Sediment Geochemistry Applied to Mineral Exploration," by Coker et al, *Geological Survey of Canada,* Economic Geology Report 31, pp. 435–478 (1979);

"Prospecting by Use of Lake Sediments in Areas of Industrial Heavy Metal Contamination," by Allan et al, *Prospecting in Areas of Glaciated Terrain,* pp. 87–111 (edited by M. J. Jones, published by Institute of Mining and Metallurgy of London, 1975);

"Relation of Lake Sediment Composition to Mineralization in Different Limnological Environments in Canada," by Nichol et al, *Prospecting in Areas of Glaciated Terrain,* pp. 112–125 (edited by M. J. Jones, published by Institute of Mining and Metallurgy of London, 1975); and

*Geochemistry in Mineral Exploration,* by Herbert E. Hawkes and John S. Webb, Chap. IV—Lake Sediments, pp. 419–425 (2d ed., 1979).

In producing the taconite pellet of the present invention, Gyttja is removed from the lake bottom and screened to remove large particles such as vegetation that has not decomposed. The water content of the Gyttja is then reduced below 50% on a weight basis. Water can even be removed until the Gyttja is dry to the touch. Water is removed using conventional methods such as drying or mechanical separation such as filtration. No screening of the Gyttja is necessary except to remove large undecomposed particles of vegetation since it has a naturally fine particle size.

The Gyttja is then mixed with finely ground taconite ore and pelletized using standard pelletizing equipment. Typically, 0.5% to 5% on a weight basis of Gyttja is mixed with the taconite ore with 1% being a preferred concentration. The water content of the pellet is approximately 8% to 12%.

The pellet at this point in the process is referred to as a "green pellet" and is placed in a kiln or furnace for hardening. The organic portion of the Gyttja has excellent water absorption properties which increases the integrity of the pellet until it is hardened. During processing in the kiln or furnace, the organic portion of the Gyttja is burned off, leaving a superior hardened clay pellet.

Gyttja is preferably used alone but it can be used as a supplemental binder with another popular binder such as Bentonite. Even when used with another binder, Gyttja will upgrade the iron content of the pellet when the organic fraction is burned off in the kiln or furnace. The organic fraction of Gyttja decreases the amount of energy required to fire the green taconite pellets in the kiln or furnace.

One great advantage of Gyttja, especially over the presently popular binder Bentonite, is that Gyttja reduces the silica content of the taconite pellet. This in turn reduces the amount of slag produced in the blast furnace. The quantity of slag impacts furnace productivity and the amount of fuel used in the furnace.

The alkali content of the pellet is also decreased. Alkalis cause both pellets and coke (fuel) to deteriorate and form scabs on the blast furnace wall. Fuel use rate and productivity suffers due to large scab formation.

Gyttja is readily available in northern Minnesota where a majority of the taconite pellet facilities are found in the United States. Binders such as Bentonite, which is mined in Wyoming and Montana, must be shipped to northern Minnesota where the taconite pellets are formed. Gyttja can be mined in the vicinity of the taconite processing facilities with a tremendous reduction in transportion costs realized.

Some metallurgical benefits are also experienced from the use of Gyttja as a binder for taconite pellets. Due to the burning off of the organic fraction, the porosity of the pellet is increased, increasing the heat transfer capability of the pellet. Reducibility is also improved.

The following example is illustrative only and is not intended to limit the present invention. The example is submitted in order to demonstrate more explicitly the formation of a taconite pellet using Gyttja as a binder.

EXAMPLE

As a specific example of my invention, I produced green taconite pellets using Gyttja as a binding agent. Gyttja with approximately a 30% organic fraction was obtained from a Minnesota lake and then dried until it was dry to the touch. Using processed taconite ore, which is made up primarily of the mineral magnetite, I mixed approximately 1% dried Gyttja with the ore. I then added approximately 15% water to the Gyttja and ore mixture. The mixture was then balled to produce green pellets. The results were taconite pellets of approximately $\frac{3}{8}''$ to $\frac{1}{2}''$ in diameter exhibiting excellent properties for firing in a kiln or furnace.

Although the present invention has been described with reference to preferred embodiments, workers skilled in the art will recognize that changes may be made in form and detail without departing from the spirit and scope of the invention.

What is claimed is:

1. A method of forming an iron ore pellet which contains a finely ground iron ore concentrate, the method comprising:
   - reducing water content of naturally found Gyttja to a maximum of 50%;
   - mixing the Gyttja with the finely ground iron ore; and
   - pelletizing the finely ground iron ore and Gyttja to form a green pellet.

2. The method of claim 1 and further including the step of:
   - raising the temperature of the pellet sufficiently to burn off an organic fraction of the Gyttja and to harden a mineral portion of the Gyttja to form a hard iron ore pellet.

3. The method of claim 1 wherein the Gyttja has an organic fraction of approximately 20%–75% by weight.

4. The method of claim 1 wherein the Gyttja is mixed with the iron ore at a concentration between approximately 0.5%–5% by weight.

5. The method of claim 4 wherein the Gyttja concentration is approximately 1% by weight.

6. The method of claim 1 wherein the green pellet has a water content of approximately 8%–12% by weight.

* * * * *